US006270008B1

(12) United States Patent
Kouyoumdjian

(10) Patent No.: US 6,270,008 B1
(45) Date of Patent: Aug. 7, 2001

(54) CONTAINER HAVING A CLOSURE FLAP THAT INCLUDES AN ARCUATE FREE END

(75) Inventor: Krikor Kouyoumdjian, Quebec (CA)

(73) Assignee: Puzant Khatchadourian, New York, NY (US)

( * ) Notice: Subject to any disclaimer, the term of this patent is extended or adjusted under 35 U.S.C. 154(b) by 0 days.

(21) Appl. No.: 09/565,839

(22) Filed: May 5, 2000

(51) Int. Cl.[7] ..... B65D 5/10
(52) U.S. Cl. ..... 229/153; 229/152; 229/906
(58) Field of Search ..... 229/151, 152, 229/153, 902, 906

(56) References Cited

U.S. PATENT DOCUMENTS 1,539,676 * 5/1925 LaBombarde ..... 229/152
2,116,652 * 5/1938 Adler ..... 229/153
2,322,389 * 6/1943 Price ..... 229/153
3,048,321 * 8/1962 Sanford ..... 229/153
3,625,412 * 12/1971 Roseberg, Jr. ..... 229/152
4,479,588 * 10/1984 Davis et al. ..... 229/151
4,770,338 * 9/1988 Tatasch ..... 229/153
4,978,009 * 12/1990 Pany ..... 229/152
5,503,325 * 4/1996 Nelson et al. ..... 229/151

* cited by examiner

*Primary Examiner*—Gary E. Elkins
(74) *Attorney, Agent, or Firm*—Darby & Darby

(57) ABSTRACT

A container is formed from a unitary blank of foldable sheet material. The container includes a base wall and a first closure flap foldably attached to the base wall along a first edge thereof. A rear wall is foldably attached to the base wall along a second edge thereof. The second edge has a first end adjacent to the first edge. A top wall is foldably attached to the rear wall. A front wall is foldably attached to the top wall. The closure flap comprises a side wall that is foldably attached to the base wall and a locking flap that is foldably attached to the side wall along a locking flap fold line. The locking flap has a free edge opposite to the fold line. The free edge is arcuate for at least a portion of its length. The arcuate portion is curved inwardly toward the locking flap fold line.

16 Claims, 4 Drawing Sheets

FIG 3
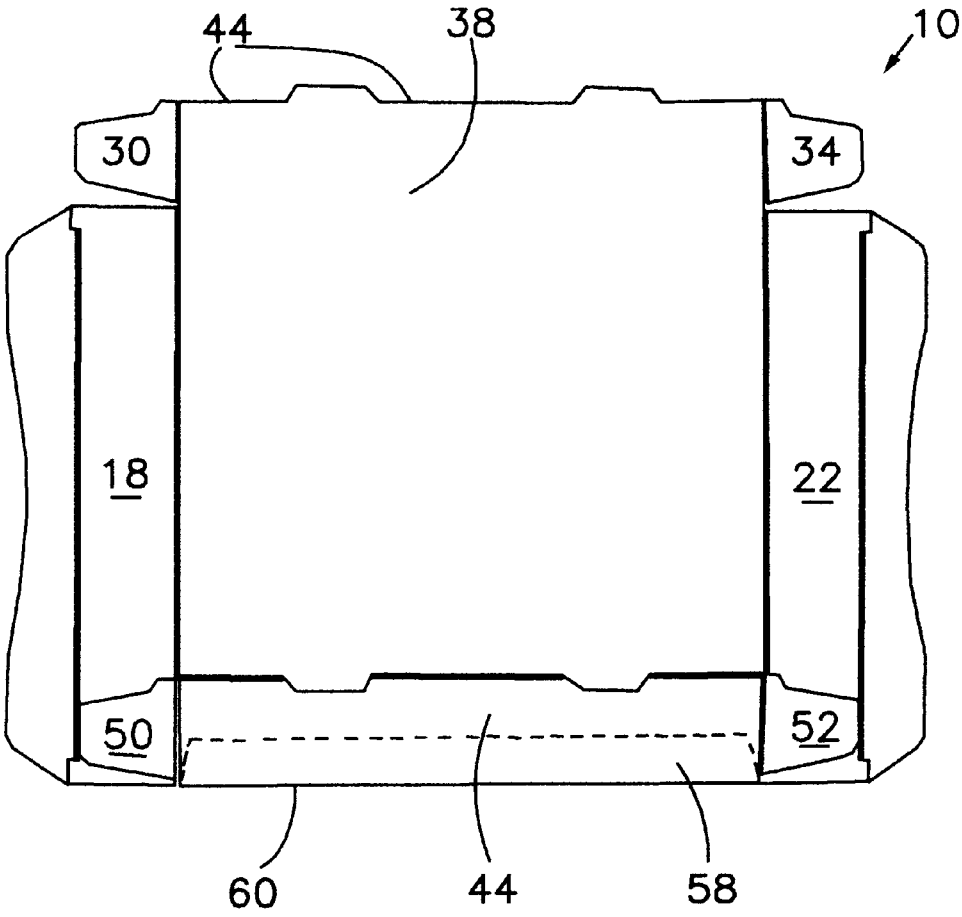
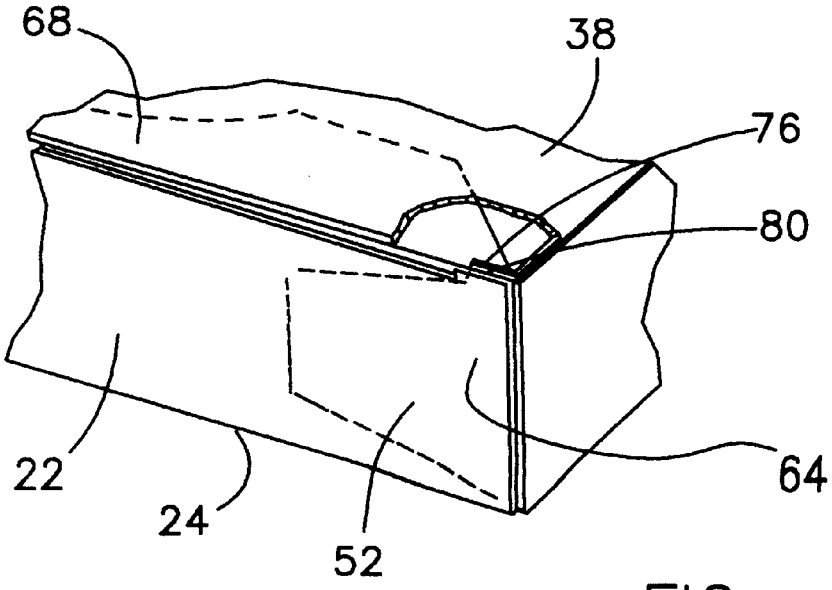
FIG 7

CONTAINER HAVING A CLOSURE FLAP THAT INCLUDES AN ARCUATE FREE END

BACKGROUND OF THE INVENTION a. Field of the Invention

The present invention relates to a container for a food product. More specifically, the present invention relates to a container for a food product that is formed from a blank of foldable sheet material.

b. Discussion of the Related Art

Containers for food products are generally manufactured for the specific product to be packaged. For example, a conventional container for pizza generally has a relatively large square bottom wall portion and a top wall portion that has the same dimensions as the bottom wall Four side walls are hingedly connected to the bottom wall. One of the side walls also is hingedly connected to the top wall so that the top wall can be folded over on top of the bottom wall to close the container, thereby enclosing the pizza. These type of conventional pizza boxes are typically used in pizzerias and are stored as flat blanks or are assembled and stored in an open nested condition or are closed and stored in an assembled condition.

U.S. Pat. No. 5,921,170 to Katchadourian et al., which is commonly owned with the present invention and hereby incorporated in its entirety by reference, is directed towards an apparatus and method for making pizza. This apparatus and method automatically prepares and bakes a fresh pizza. Thus, a need has arisen for a container that can be formed from a unitary blank of foldable sheet material, and stored in a folded, flat position to minimize the space that the stack of containers take up within the apparatus. Additionally, there is a need for a container that can be easily removed from the stack of folded, flat blanks into a predetermined position where the container can be assembled to permit a food product, such as a pizza, to be inserted into the interior of the container. There is a further need for a container whose closure flaps can be automatically closed without jamming so that the package can be delivered to the end user while protecting the food product.

Currently, there are no containers that satisfy these needs. The conventional pizza box is intended to be used by hand, and the hingeable top wall is too large to be reliably handled by automated processes. Accordingly, it is an object of the present invention to provide a container that satisfies these needs.

SUMMARY OF THE INVENTION

A preferred embodiment of the present invention that demonstrates various features, objects and advantages thereof, includes a container for a food product. The container is formed from a unitary blank of foldable sheet material. The container includes a base wall and a first closure flap foldably attached to the base wall along a first edge thereof. A rear wall is foldably attached to the base wall along a second edge thereof. The second edge has a first end adjacent to the first edge. A top wall is foldably attached to the rear wall. A front wall is foldably attached to the top wall. The closure flap comprises a side wall that is foldably attached to the base wall and a locking flap that is foldably attached to the side wall along a locking flap fold line. The locking flap has a free edge opposite to the fold line. The free edge is arcuate for at least a portion of its length. The arcuate portion is curved inwardly toward the locking flap fold line.

BRIEF DESCRIPTION OF THE DRAWING FIGURES

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

FIG. 3 is a plan view of the blank folded so that the glue flap can be attached to a side wall, thereby forming a container;

FIG. 7 is a partial perspective view of the closure flap with part of the top wall broken away.

DETAILED DESCRIPTION OF THE PREFERRED EMBODIMENT

Referring now to FIGS. 1–7, a package or container for a food product formed from a unitary blank 14 of foldable sheet material in accordance with the present invention is illustrated. Container 10 is formed from a one-piece blank 14.

Container 10 is suitable for protecting, thermally insulating and transporting relatively large food items. Container 10 preferably encloses a relatively large flat food item, such as a pizza, and therefore, container 10 has a relatively large generally square or rectangular-shaped bottom wall and relatively short side walls, as will be discussed in detail below.

Container 10 is formed from a blank 14 that is preferably made from a heavy paper board and/or corrugated paper material. If blank 14 is formed of paper or paper board material, preferably at least the inner and/or the outer surfaces of the formed container 10 are coated with any conventional coating commonly applied to non-plastic food containers. The coating is the type to make the paper or paper board resistant to the penetration of grease or the like. With such a coating, the container surfaces could be used as a support surface while consuming the pizza without the problem of grease penetration. Alternatively, as one skilled in the art would appreciate, the container could be formed from metal foil, plastic sheet material, filmed plastic or any other well known material for fabricating containers for food or the like. Whatever the selected material, it should be somewhat flexible and resilient, but it must provide the requisite strength for protecting the contents of the container.

Figure 1:
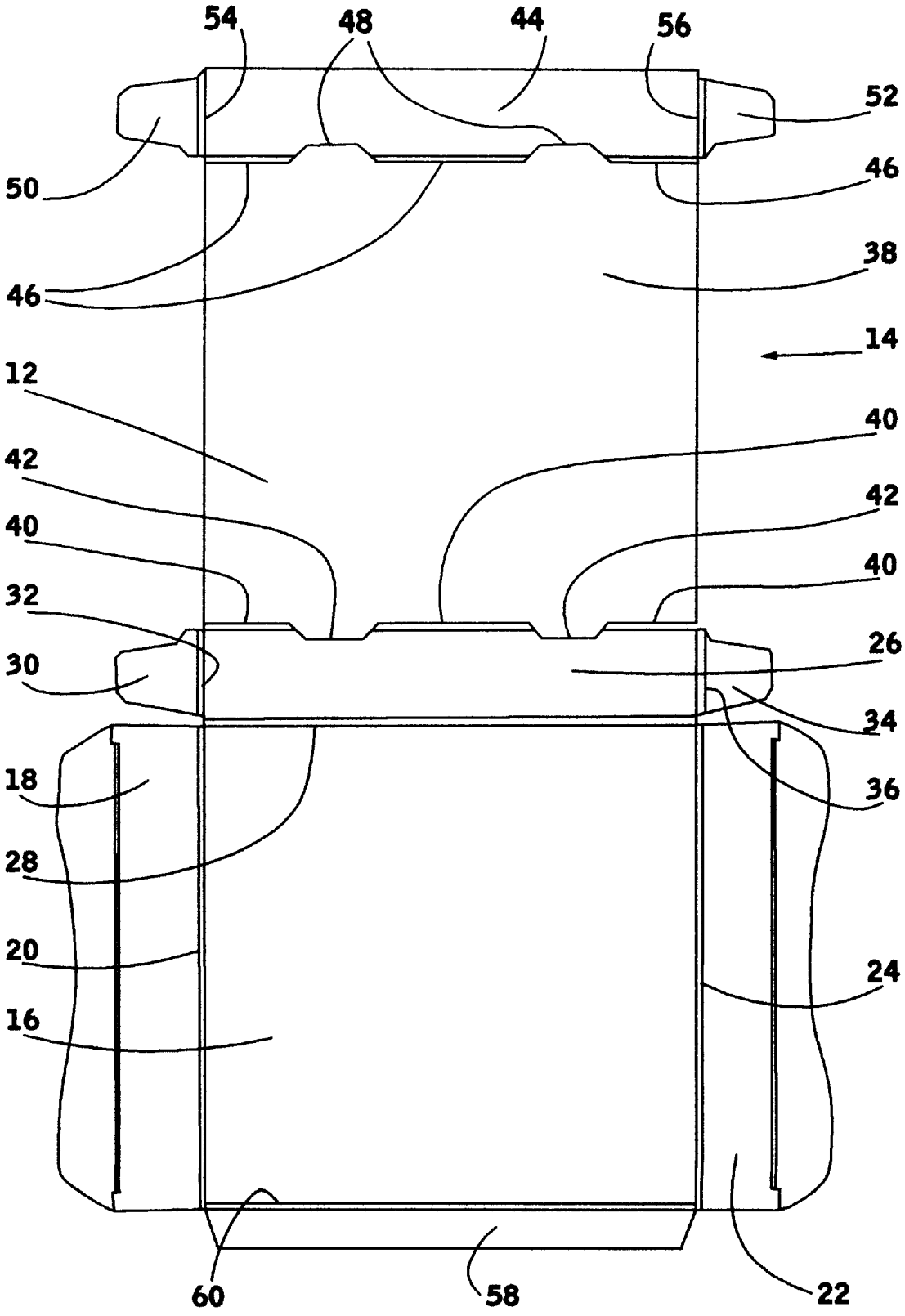
FIG. 1 is a top plan view of a blank for forming the package according to the present invention.
Figure 2:
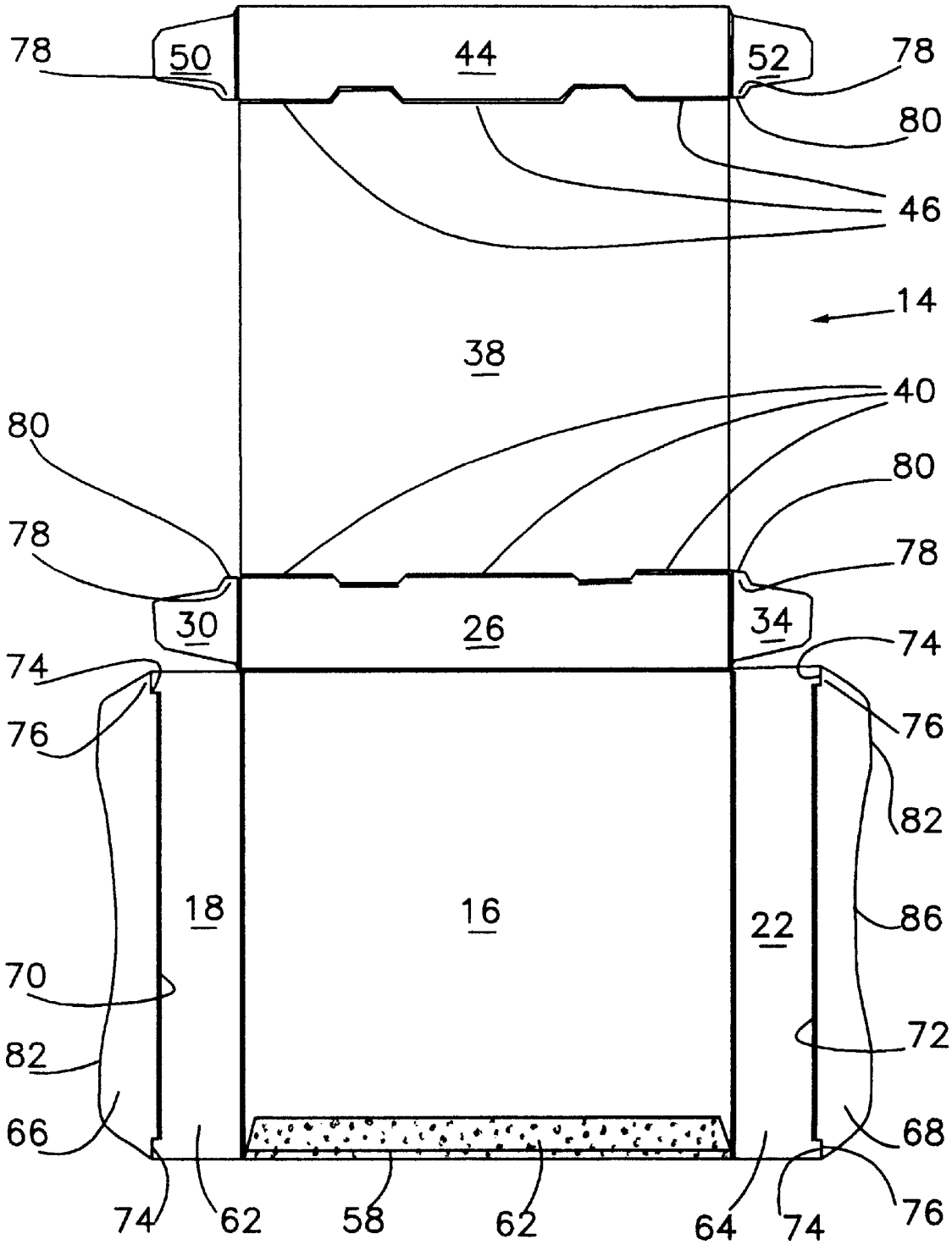
FIG. 2 is a top plan view of the blank of FIG. 1 with a glue flap in a folded position.

With reference to FIGS. 1 and 2, blank 14, for forming container 10, includes a first or base wall 16. It is apparent from the drawings that base wall 16 will form a lower wall of the completed container 10. It should be noted that relative terms, such as "lower", "rear", "front", "downwardly", etc., are used herein for the sake of clarity in describing the present invention with respect to the drawing Figures. Of course, if the container is held in a different position than the one illustrated, the "downward" direction may becom upward or any other direction.

A first closure flap 18 is foldably attached to base wall 16 along a first fold line or edge 20 thereof. A second closure flap 22 is foldably attached to base wall 16 along a third fold line or edge 24 thereof. First edge 20 is located opposite from third edge 24. A rear wall 26 is foldably attached to base wall 16 along a second fold line or edge 28 of base wall 16. At one end, second edge 28 is disposed adjacent to first edge 20. At an opposite second end, second edge 28 is disposed adjacent to third edge 24. A first tab 30 is foldably attached to rear wall 26 at a first fold line or edge 32 thereof. A second tab 34 is foldably attached to rear wall 26 at a second fold line or edge 36 thereof. First edge 32 is disposed opposite to second edge 36, as illustrated in FIGS. 1 and 2. A top wall 38 is foldably attached to rear wall 26 along a third edge or fold line 40 of rear wall 26. Fold line 40 is interrupted by a pair of score lines 42, which when the container is assembled forms a pair of vents for the container and also provides a support surface by which the container may be guided when being handled by machinery during transport from one location to another location.

A front wall 44 is foldably attached to top wall 38 along a first fold line or edge 46 of top wall 38. Fold line 46, like fold line 40, is interrupted by a pair of score lines 48, which provide the assembled container with another pair of vents and guides for assisting in guiding the container when being handled by machinery. Like rear wall 26, front wall 44 also includes a first tab 50 and a second tab 52. First tab 50 is foldably attached to front wall 44 at a first fold line or edge 54 thereof. Second tab 52 is foldably attached to front wall 44 at a second fold line or edge 56 thereof.

A glue flap 58 is foldably attached to base wall 16 along a fourth edge or fold line 60 thereof. As illustrated in FIG. 2, glue flap 58 is folded about fold line 60 thereby revealing that one side of glue flap 58 is provided with an adhesive 62.

To form container 10 from blank 14, glue tab 58 is folded to the position illustrated in FIG. 2 so that adhesive 62 is facing upwardly. Blank 14 is then folded about fold line 40 to the position illustrated in FIG. 3 so that the free end of rear wall 44 aligns with the fourth edge or fold line 60 of base wall 16 and glue flap 58 is sandwiched between base wall 16 and front wall 44. Front wall 44 can now be attached to glue tab 58 via adhesive 62. The blank is now in a flat, folded position which is suitable for shipping and storing in stacks. When stored in stacks, the top or bottom blank in the stack can be easily removed, manually or by machine, and moved to any desired location. For example, the top flat, folded blank can be moved by machinery into a position where it can be moved from the flat, folded position of FIG. 3 to the assembled, closure flap open position of FIGS. 4–6. This movement can be accomplished by, for example, supporting one end of the folded blank at fold line 60 and applying a force at the opposite end of the folded blank at fold line 40 in the direction toward fold line 60. This force will cause the blank to move into the assembled, but closure flap open position illustrated in FIGS. 4–6.

Referring now to FIG. 2, each closure flap 18, 22 is comprised of side wall portion 62, 64 and a locking flap portion 66, 68, respectively. Sidewall portions 62, 64 each have a height corresponding to the height of rear wall 26 and front wall 44. Locking flap 66, 68 is foldably attached to side wall 62, 64 along fold line 70, 72, respectively. As illustrated in FIGS. 1 and 2, each fold line 70, 72 does not extend to the ends of the respective side wall and locking flap, instead an L-shaped score line 74 is disposed at each end, thereby forming a V-shaped locking ledge portion 76 at each end of the locking flap 66, 68.

Each tab 30, 34, 50, 52 has an L-shaped projection or shoulder 78 at its end adjacent to top wall 38. Each L-shaped projection 78 is defined in part by a first end wall portion 80 that extends essentially linearly and approximately parallel to fold lines 40, 46, respectively, which is approximately parallel to second edge 28 of rear wall 26. First end wall portion 80 extends for approximately a slightly lesser length than the distance that L-shaped projection 76 extends.

Figure 4:
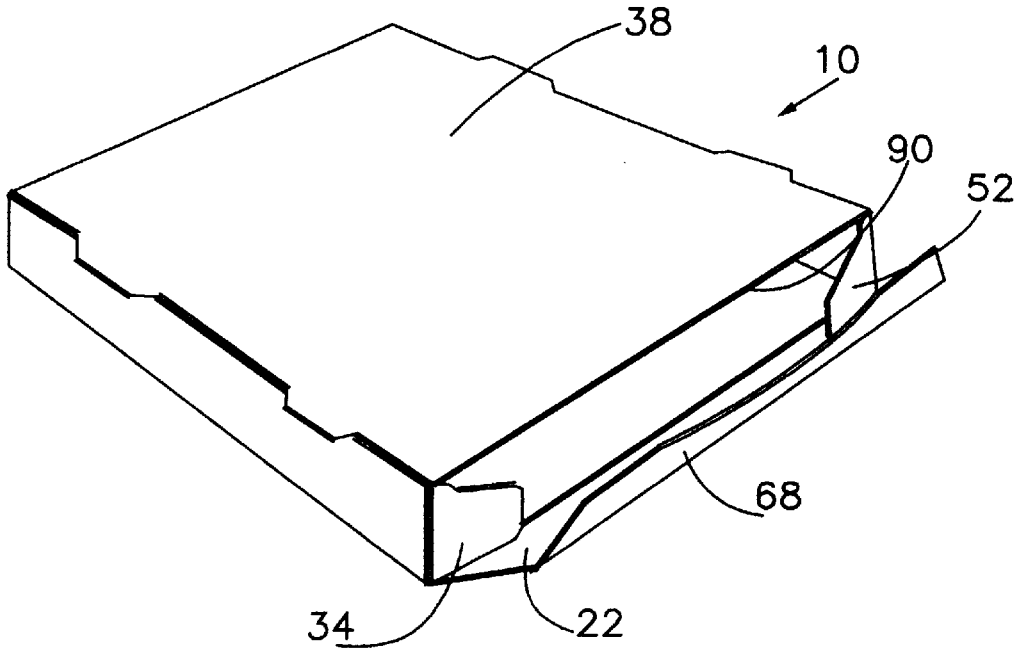
FIG. 4 is a perspective view of the package of FIG. 3 in the assembled position with the closure flaps shown in the open position.
Figure 5:
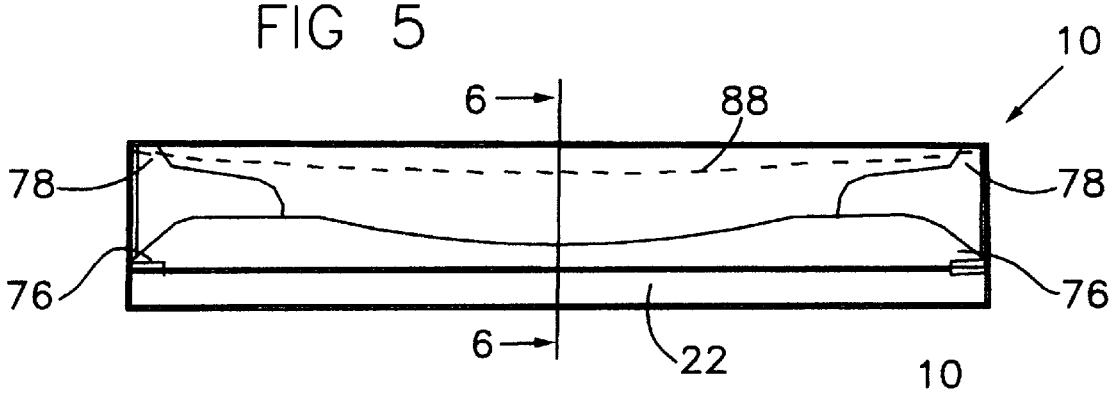
FIG. 5 is a right side view of the package of FIG. 4, with the package in the assembled position and the closure flap in the open position.
Figure 6:
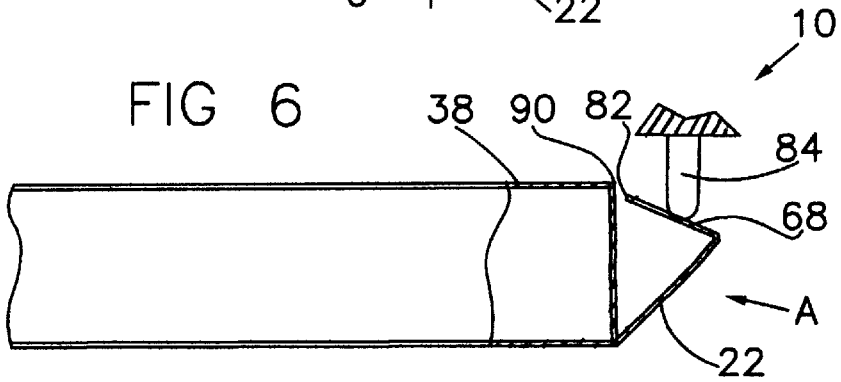
FIG. 6 is a cross-sectional view taken along lines 6—6 of FIG. 5 and looking in the direction of the arrows.

Referring now to FIGS. 4–7, to move the closure flap 22, 18 from the open position as illustrated in FIGS. 4–6 to the closed position illustrated in FIG. 7, the respective set of tabs 34, 52 or 30, 50 are first moved inwardly to approximately the position illustrated in FIGS. 4 and 5. Locking flap portion 68, 66 is then moved downwardly, by for example, a mechanical finger 84, which applies a downward force to closure flap 68, 66.

As illustrated in the Figures, free end 82 of closure flap 68, 66 is arcuate for a major portion of its length. This arcuate shaped portion 86 is curved inwardly towards the respective locking flap fold line 70, 72. Free end 82 of the locking flap is curved inwardly towards its respective locking flap fold line because, in the assembled position of FIGS. 4–6, top wall 38 will, in practice, sometimes sag from the horizontal position illustrated in FIGS. 4–6 to the exaggerated position illustrated by dashed line 88 in FIG. 5. Thus, when a closing force is applied by a second member in the direction indicated by arrow A in FIG. 6 by, for example, another mechanical finger (not shown), closure flap 68 will be inserted inside of container 10 underneath top wall 38 to the position shown in FIG. 7. Thus, even if top wall 38 sags to some extent, as indicated in an exaggerated manner in FIG. 5 by dashed line 88, locking flap 68 will still be smoothly inserted into the interior of the container. The present inventors have found that if folding flap 66, 68 is not formed with an arcuate free end that curves inwardly towards the respective locking flap fold line, during this closing process the locking flap 66, 68 will often jamb against the end wall 90 of top wall 38.

Referring now to FIGS. 5 and 7, as the closure flap 66, 68 is moved into the locking flap closed position of FIG. 7, locking ledge 76 of the locking flap will be guided up and over the respective tab, including its shoulder 78 until locking ledge 76 is disposed interiorly of projection 78, at which time ledge 76 snaps downwardly into the locking flap closed position as illustrated in FIG. 7. A similar operation will then be performed to close the opposite closure flap 18.

Of course, before either the first, second or both closure flaps are closed, machinery may be used to insert a food product, such as, for example, a pizza into the interior of the container. Thereafter, the first, second or both closure flaps can be closed and the container can be delivered to the end user.

Having described the presently preferred exemplary embodiment of a container having a closure flap that includes an arcuate free end in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

What is claimed is:

1. A container for a food product, said container being formed from a unitary blank of foldable sheet material, said container comprising:

a base wall, a first closure flap foldably attached to said base wall along a first edge thereof, a rear wall foldably attached to said base wall along a second edge thereof, said second edge having a first end adjacent to said first edge;

a top wall foldably attached to said rear wall;

a front wall foldably attached to said top wall;

wherein, said closure flap comprises a side wall foldably attached to said base wall and a locking flap foldably attached to said side wall along a locking flap fold line, said locking flap having a free edge opposite to said fold line, said free edge being arcuate for at least a portion of its length, said arcuate portion being curved inwardly toward said locking flap fold line.

2. The container according to claim 1, further comprising:

a first tab foldably attached to said rear wall at a first edge thereof, a second tab foldably attached to said rear wall at a second edge thereof, said first edge being disposed opposite to said second edge.

3. The container according to claim 2, further comprising:

a third tab foldably attached to said front wall at a first edge thereof, a fourth tab foldably attached to said front wall at a second edge thereof, said first edge of said front wall being disposed opposite to said second edge of said front wall.

4. The container according to claim 1, wherein an L-shaped score line is disposed at each end of said fold line.

5. The container according to claim 3, wherein an L-shaped score line is disposed at each end of said fold line.

6. The container according to claim 5, wherein each of said tabs has an L-shaped projection at its end adjacent to said top wall.

7. The container according to claim 6, wherein each of said L-shaped projections is defined, in part, by a first end wall that extends essentially linearly.

8. The container according to claim 7, wherein each of said first end walls is approximately parallel to said second edge of said rear wall.

9. A container for a food product, said container being formed from a unitary blank of foldable sheet material, said container comprising:

a base wall, a first closure flap foldably attached to said base wall along a first edge thereof, a second closure flap foldably attached to said base wall along a third edge thereof that is disposed opposite to said first edge;

a rear wall foldably attached to said base wall along a second edge thereof, said second edge having a first end adjacent to said first edge and a second end adjacent to said third edge;

a top wall foldably attached to said rear wall;

a front wall foldably attached to said top wall;

wherein, each of said closure flaps comprises a side wall foldably attached to said base wall and a locking flap foldably attached to said side wall along a locking flap fold line, said locking flap having a free edge opposite to said fold line, said free edge being arcuate for at least a portion of its length, said arcuate portion being curved inwardly toward said locking flap fold line.

10. The container according to claim 9, farther comprising:

a first tab foldably attached to said rear wall at a first edge thereof, a second tab foldably attached to said rear wall at a second edge thereof, said first edge being disposed opposite to said second edge.

11. The container according to claim 10, further comprising:

a third tab foldably attached to said front wall at a first edge thereof, a fourth tab foldably attached to said front wall at a second edge thereof, said first edge of said front wall being disposed opposite to said second edge of said front wall.

12. The container according to claim 9, wherein an L-shaped score line is disposed at each end of said fold line.

13. The container according to claim 12, wherein an L-shaped score line is disposed at each end of said fold line.

14. The container according to claim 13, wherein each of said tabs has an L-shaped projection at its end adjacent said top wall.

15. The container according to claim 14, wherein each of said L-shaped projections is defined, in part, by a first end wall that extends essentially linearly.

16. The container according to claim 15, wherein each of said first end walls is approximately parallel to said second edge of said rear wall.

* * * * *